US009945626B2

(12) United States Patent
Rosenthal

(10) Patent No.: US 9,945,626 B2
(45) Date of Patent: Apr. 17, 2018

(54) UNIVERSAL FIREARM MOUNTED RECEIVING APPARATUS FOR CASINGS

(71) Applicant: Joseph Rosenthal, Tucson, AZ (US)

(72) Inventor: Joseph Rosenthal, Tucson, AZ (US)

( * ) Notice: Subject to any disclaimer, the term of this patent is extended or adjusted under 35 U.S.C. 154(b) by 0 days.

(21) Appl. No.: 15/308,072

(22) PCT Filed: Apr. 29, 2015

(86) PCT No.: PCT/US2015/028340

§ 371 (c)(1),
(2) Date: Oct. 31, 2016

(87) PCT Pub. No.: WO2015/168317

PCT Pub. Date: Nov. 5, 2015

(65) Prior Publication Data

US 2017/0097201 A1 Apr. 6, 2017

Related U.S. Application Data

(63) Continuation of application No. 14/267,822, filed on May 1, 2014, now Pat. No. 9,360,264.

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98; 89/33.4
See application file for complete search history.

(56) References Cited

U.S. PATENT DOCUMENTS

| | | | | | |
|---|---|---|---|---|---|
| 1,201,189 | A | * | 10/1916 | Johnson | F41A 9/60 224/0.5 |
| 2,331,033 | A | | 10/1943 | La Porte | |
| 2,336,557 | A | | 12/1943 | McCallister | |
| 2,354,277 | A | * | 7/1944 | Richardson | F41A 9/60 42/98 |
| 2,364,509 | A | | 12/1944 | Bertran et al. | |
| 2,415,153 | A | | 2/1947 | Trimbach et al. | |
| 2,866,289 | A | * | 12/1958 | Wilcox | F41A 9/60 42/87 |
| 3,011,408 | A | * | 12/1961 | Brothers, Jr. | F41A 9/54 193/32 |
| 3,144,810 | A | | 8/1964 | Stanton et al. | |
| 3,153,981 | A | | 10/1964 | Brass | |
| 3,288,029 | A | | 11/1966 | Birath | |
| 3,618,458 | A | * | 11/1971 | Pruonto et al. | F41A 9/60 42/98 |
| 3,658,241 | A | | 4/1972 | Pistocchi | |

(Continued)

OTHER PUBLICATIONS

International Search Report dated Jul. 24, 2015, PCT/US2015/028340.

*Primary Examiner* — John Cooper
(74) *Attorney, Agent, or Firm* — Gavin J. Milczarek-Desai; Quarles & Brady LLP

(57) ABSTRACT

A universal firearm-mounted receiving apparatus adapted to receive an ejected casing from a firearm (FIG. 1). The apparatus has an arm with a mounting piece disposed at one end and a receptacle for shell casings disposed at the other end (opposite to) mounting piece. The arm further contains one or more hinges that allow(s) at least a portion of the arm to move independently of another portion, thereby making the arm and receptacle positionable for a variety of different firearms.

12 Claims, 4 Drawing Sheets

(56) References Cited

U.S. PATENT DOCUMENTS 3,739,685 A * 6/1973 Lundgren ..... F41A 9/60 42/98
3,771,248 A 11/1973 Lineham
4,020,738 A * 5/1977 Martinez ..... F41A 9/60 42/98
4,028,834 A * 6/1977 Dobson ..... F41A 9/60 42/98
4,334,375 A * 6/1982 Olson ..... F41A 9/60 42/98
4,430,820 A * 2/1984 Marsh ..... F41A 9/60 42/98
4,594,803 A * 6/1986 Muncy ..... F41A 9/60 42/98
4,715,141 A * 12/1987 Kohnke ..... F41A 9/60 42/98
4,903,426 A * 2/1990 Bammate ..... F41A 9/60 42/98
5,138,787 A * 8/1992 Riddle ..... F41A 9/60 42/98
D382,624 S * 8/1997 Benson ..... D22/108
5,934,002 A * 8/1999 Blanchet ..... F41A 9/60 42/98
D427,273 S 6/2000 Plonka
6,173,520 B1 * 1/2001 Bucciarelli ..... F41A 9/60 42/98
6,347,475 B1 * 2/2002 Trostel ..... F41A 9/60 42/98
6,530,169 B1 * 3/2003 Griffin ..... F41A 9/60 42/98
6,836,991 B1 1/2005 Saur
7,043,863 B2 * 5/2006 Saur ..... F41A 9/60 206/3
7,168,200 B2 1/2007 Perez
7,380,364 B1 * 6/2008 Hanson ..... F41A 9/60 42/98
7,941,961 B1 * 5/2011 Cooper ..... F41G 11/003 42/98
8,448,363 B2 5/2013 Fargnoli
9,366,491 B1 * 6/2016 Baxley ..... F41A 23/16
2006/0101699 A1 * 5/2006 Perez ..... F41A 9/60 42/98
2013/0305583 A1 11/2013 Dreiband
2015/0316338 A1 * 11/2015 Rosenthal ..... F41A 9/54 42/98
2017/0097201 A1 * 4/2017 Rosenthal ..... F41A 9/60

* cited by examiner

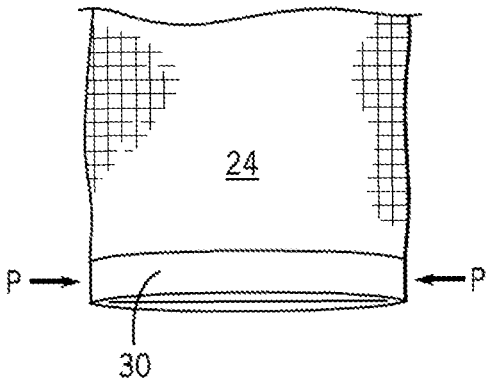
FIG. 5
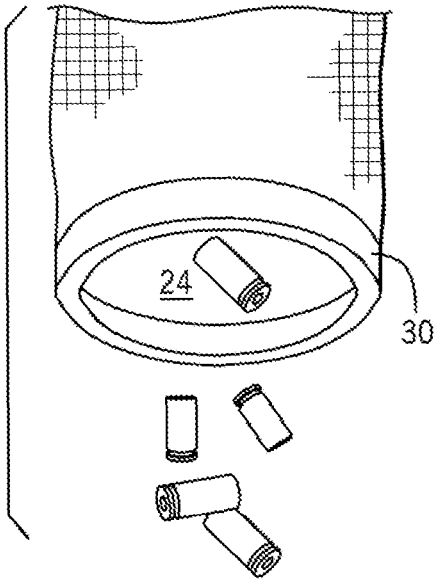
FIG. 6
FIG. 7
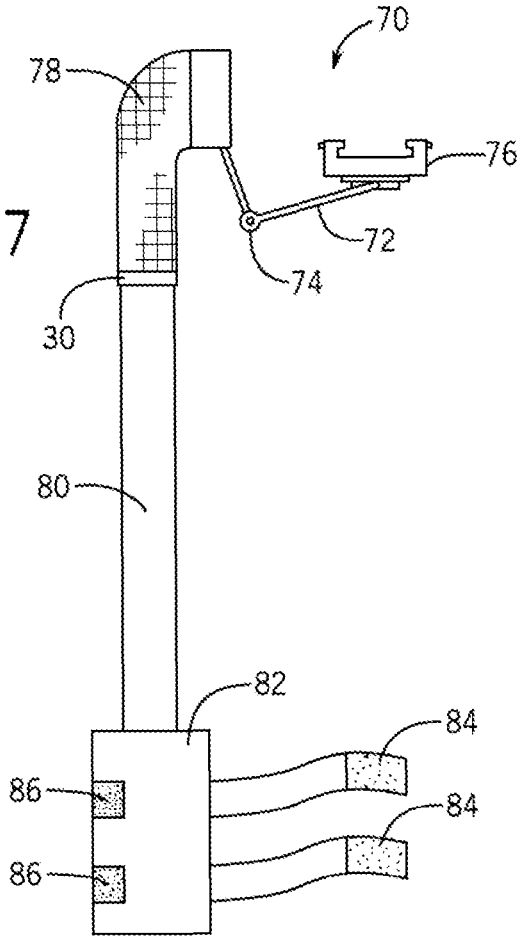

UNIVERSAL FIREARM MOUNTED RECEIVING APPARATUS FOR CASINGS

CROSS-REFERENCE TO RELATED APPLICATIONS

This application is a 371 application of PCT/US2015/028340 filed Apr. 29, 2015, which claims priority to U.S. patent application Ser. No. 14/267,822 filed on May 1, 2014.

TECHNICAL FIELD

This invention relates to the field of firearm accessories and more particularly receiving apparatus for spent casings.

BACKGROUND

Because it can be very difficult to recover expended shell casings, especially when those are discharged from semi-automatic or automatic firearms or during maneuvers or live fire problems performed in open terrain during training exercises, numerous bags, buckets, and the like have been conceived for providing a catching function. The casings, which typically are made of brass, expended by the weapon are valuable and can be reused. Therefore, recovery is desirable. Even with the exercise of great diligence, however, it can be difficult to recover more than a majority of the expended casings.

Moreover, a problem long associated with hunting and recreational shooting is the amount of empty shells which are expelled from a shotgun or a rifle and which fall on the ground, sometimes in tall grass. These casings need to be retrieved in order to protect the environment and to remove the smell of empty shells from the habitat of a prey. Sometimes, especially while bird hunting, the hunter has to spend hours searching for the empty shells and retrieving them, while at the same time the hunter has to follow his prey and move continuously.

Depending on the type and configuration of a firearm, mounting a receiving apparatus for spent casings can be difficult and/or an apparatus for one weapon may not usable for another. Of course, purchasing a different casing receiving apparatus for each weapon is costly.

Accordingly, improved and universal firearm-mounted receiving apparatus for catching spent casings are described below.

SUMMARY OF THE INVENTION

In one embodiment, a universal firearm-mounted receiving apparatus adapted to receive an ejected casing from a firearm is disclosed. A mounting piece is disposed at an end of an arm and a receptacle disposed on the arm-end opposite to the mounting piece. The receiving apparatus further includes a hinge that allows for a portion of the arm to move independently of another portion, thereby making the positioning of the receptacle adjustable for different firearms.

In another embodiment, a universal firearm-mounted receiving apparatus adapted to receive an ejected casing from a firearm is disclosed that includes an arm having a mounting piece disposed at a first end of the arm and a receptacle disposed at an opposing end of the arm. Furthermore, a first hinge is disposed at the first end of the arm between the mounting piece and the arm, and a second hinge is disposed on the arm between the first hinge and the receptacle.

In another embodiment, a firearm casing collection kit is disclosed. The kit contains a firearm-mounted receiving apparatus adapted to receive an ejected casing from the firearm, the apparatus having an arm containing a hinge allowing a portion of the arm to move independently, a mounting piece disposed at an end of the arm, and receptacle disposed at an end of the arm opposite to the mounting piece. The kit further contains a tube or sleeve being adapted for attachment to a bottom of the receptacle, and a repository adapted for attachment to the tube or sleeve.

Other features and advantages of the invention will be apparent from the following detailed description and figures, and from the claims.

DESCRIPTION OF DRAWINGS

FIG. 5 depicts a bag embodiment of the receptacle of FIG. 1 that further includes a spring frame.

FIG. 6 depicts the bottom of the bag of FIG. 5 after the application of pressure to open the spring frame.

FIG. 7 depicts a kit embodiment of the invention.

DETAILED DESCRIPTION

Figure 1:
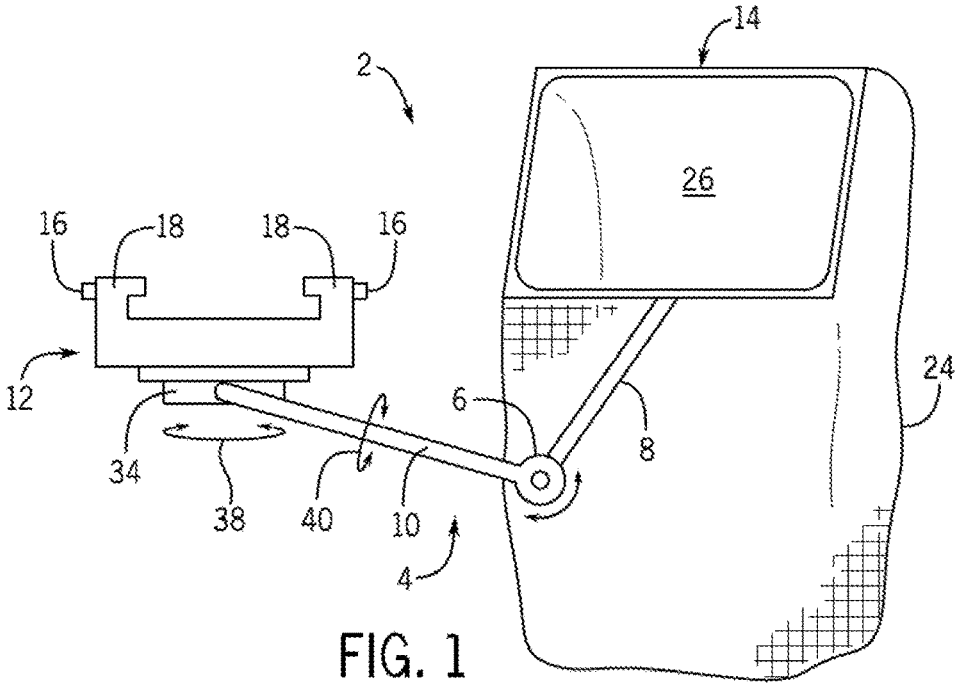
FIG. 1 depicts a first embodiment of the invention.

Turning to FIG. 1, an embodiment suitable for mounting on a rail (such as a Picatinny rail) of a firearm is shown. The universal firearm-mounted receiving apparatus 2 includes an arm 4 containing a hinge 6 allowing a portion 8 of the arm to move independently of another portion 10. A mounting piece 12 is disposed at an end of the arm 4, and a receptacle 14 is disposed at an arm end opposite to mounting piece 12.

The hinge 6 can be one of a great many varieties that allow for one or more of turning, swinging, slidable movement or other movement of one part of the arm independent of another part of the arm.

The mounting piece 12 may be a clamp with "quick release" tabs 16 that allow grooves 18 to be engaged or released from a rail on a firearm through pressure applied by a user. However, other types of attaching or clamping arrangements are useable without the need for a rail, such as a simple pressure clamp like the c-clamp 20 and wing nut 22 (for tightening/loosening the clamp) shown in FIG. 2.

As with the hinge and mounting piece, the receptacle may take a variety of forms and be made from a variety of materials. In one embodiment, the receptacle is a bag 24 attached to frame of receptacle 14 at the end of arm 4, thereby providing an opening 26 into which casings are ejected. The receptacle 14 is sized such that it can accommodate a large variety of shells sizes. As shown in FIGS. 5 and 6, a spring frame 30 may be disposed at the bottom of bag 24 such that application of pressure P at the arrows will open the bag for release of the casings.

As is further shown in FIG. 1, the universal firearm-mounted receiving apparatus 2 may additionally include another hinge 34. In this configuration, the hinge 34 is disposed at the first end of the arm between the mounting piece 12 and the arm 4, and the other hinge 6 is disposed on the arm 4 between the first hinge 34 and the receptacle 14. Hinge 34 provides for rotation of the arm radially 38 or rotation of the arm axially 40. In some embodiments, hinge 34 provides for both radial and axial movement of the arm 4 so that the receptacle 24 is positionable in a great many locations.

Overall, the apparatus 2 may be made from any rigid material (with the receptacle additionally including any material that can capture and hold an ejected casing). Materials of lighter weight are preferred, such as aluminum or PVC plastic.

Figure 3:
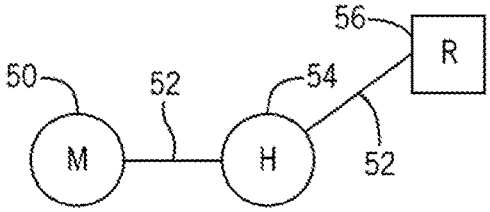
FIG. 3 schematically illustrates a simplified rendition of the components for an embodiment of the invention.
Figure 4:
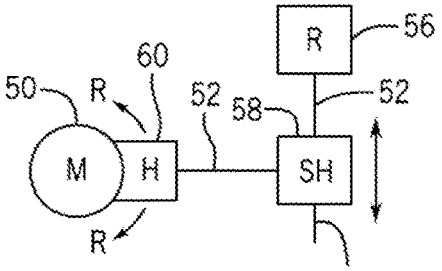
FIG. 4 schematically illustrates a simplified rendition of the components for another embodiment of the invention.

As shown in simplified block form in FIGS. 3 and 4, embodiments may include a mounting piece 50, arm 52, hinge 54 and receptacle 56. Or they may include more than one hinge. For example, hinge 58 is a slidable hinge allowing receptacle 56 to be toward or away from hinge 58, while hinge 60 allows for radial movement R.

A firearm casing collection kit also is contemplated. The kit may include a firearm-mounted receiving apparatus 70 having an arm 72 containing a hinge 74, allowing a portion of the arm to move independently, a mounting piece 76 disposed at an end of the arm, and receptacle 78 disposed at an end of the arm opposite to the mounting piece. The kit further includes a tube or sleeve 80 being adapted for attachment to a bottom of the receptacle 78, and a repository 82 adapted for attachment to the tube or sleeve.

The repository 82, in one embodiment of the kit, is especially useful for mobile training or hunting in that it is adapted for attachment to a user's leg. Thus, it can include straps 84 that loop around a leg and attach at attachment point 86 using hook-and-loop fasteners and the like.

Figure 2:
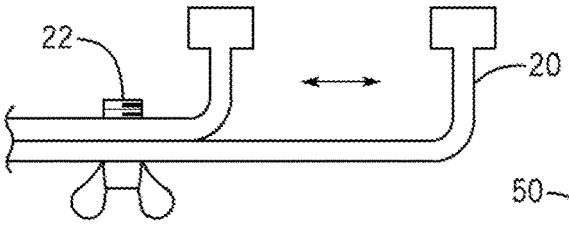
FIG. 2 illustrates one of several alternative mounting pieces for the embodiment of FIG. 1.
Figure 8:
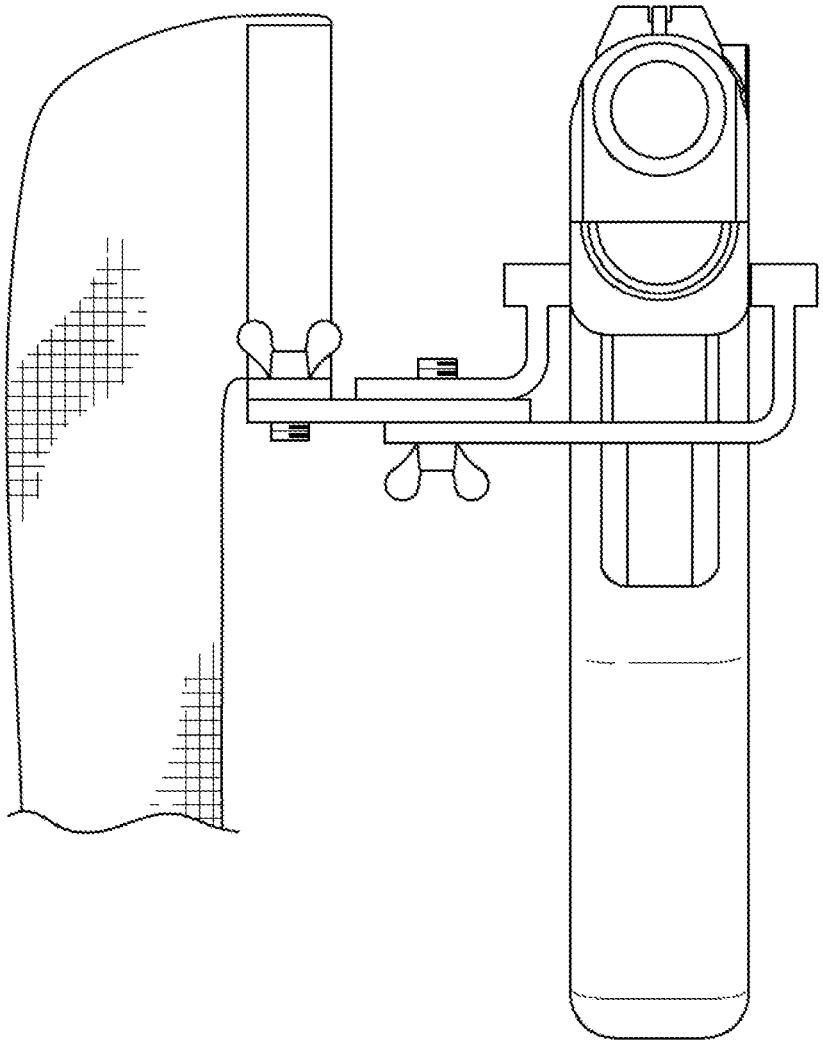
FIG. 8 depicts another embodiment of the invention attached to a firearm.
Figure 9:
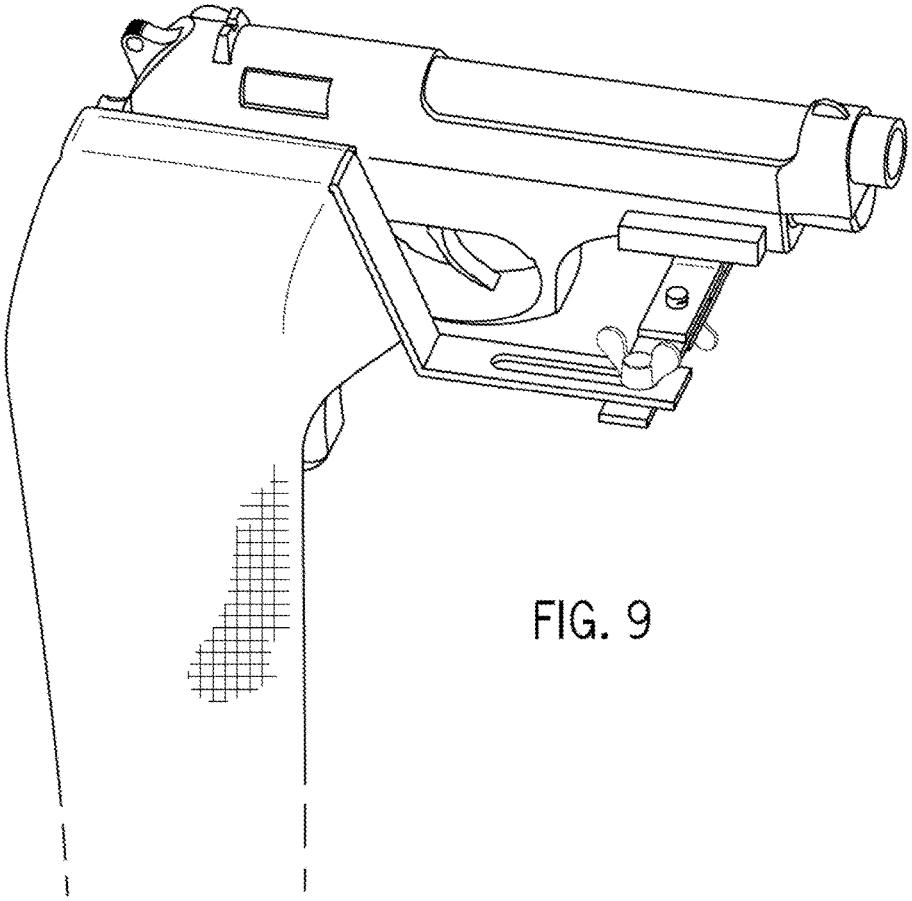
FIG. 9 depicts a perspective view of the embodiment in FIG. 8.

As seen in FIGS. 8 and 9, another embodiment of the invention is shown attached to a firearm (using the c-clamp mounting piece of FIG. 2 and a slidable hinge arrangement 88).

Thus, it is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A universal firearm-mounted receiving apparatus adapted to receive an ejected casing from said firearm, comprising:

a pair of arms, wherein a first arm of said pair of arms has a slidable or rotatable hinge disposed thereon and a second arm of said pair of arms is coupled with said slidable or rotatable hinge to thereby allow said second arm to slide along or rotate independently of the first arm;

a mounting piece disposed at an end of said first arm; and a receptacle disposed at an end of said second arm.

2. The apparatus of claim 1, wherein said hinge is a slidable hinge.

3. The apparatus of claim 1, wherein said mounting piece is a clamp.

4. The apparatus of claim 3, wherein said clamp is a quick-release clamp adapted to be mounted in a rail.

5. The apparatus of claim 1, wherein said receptacle is a bag with a spring frame disposed at a bottom thereof.

6. A universal firearm-mounted receiving apparatus adapted to receive an ejected casing from said firearm, comprising:

an arm having a mounting piece disposed at first end of said arm and a receptacle disposed at an opposing end of said arm; wherein a first hinge is disposed at said first end of the arm between the mounting piece and the arm, and a second hinge is disposed on said arm between the first hinge and the receptacle.

7. The apparatus of claim 6, wherein said first hinge provides for at least one of rotation of the arm axially and rotation of the arm radially.

8. The apparatus of claim 6, wherein said second hinge is a slidable hinge.

9. The apparatus of claim 6, wherein said first hinge provides for at least one of rotation of the arm axially and rotation of the arm radially, and wherein said second hinge is a slidable hinge.

10. The apparatus of claim 6, wherein said mounting piece is a clamp.

11. The apparatus of claim 10, wherein said clamp is a quick-release clamp adapted to be mounted in a rail.

12. The apparatus of claim 6, wherein said receptacle is a bag with a spring frame disposed at a bottom thereof.

* * * * *